US008042216B2

(12) United States Patent
Jochim et al.

(10) Patent No.: US 8,042,216 B2
(45) Date of Patent: Oct. 25, 2011

(54) ERGONOMIC BRUSH

(75) Inventors: David Jochim, Nassau Bay, TX (US); Randy Dale Steltenpohl, Cherokee Village, AR (US)

(73) Assignee: Azimuth Enterprises, LLC, Houston, TX (US)

( * ) Notice: Subject to any disclaimer, the term of this patent is extended or adjusted under 35 U.S.C. 154(b) by 701 days.

(21) Appl. No.: 12/214,933

(22) Filed: Jun. 24, 2008

(65) Prior Publication Data

US 2009/0314304 A1 Dec. 24, 2009

(51) Int. Cl.

| | |
|---|---|
| ***A46B 5/02*** | (2006.01) |
| ***A46B 7/04*** | (2006.01) |
| ***A01K 13/00*** | (2006.01) |
| ***B25G 1/10*** | (2006.01) |

(52) U.S. Cl. ..... 15/143.1; 15/159.1; 15/176.1; 15/176.6; 15/186; 16/430; 119/615; 119/633; 132/120; D4/129; D4/130; D4/138; D30/158

(58) Field of Classification Search ..... 15/143.1, 15/145, 159.1, 160, 176.1, 176.4–176.6, 15/186, 202; 16/430; 119/612, 615, 633, 119/664; 132/120, 152; D4/129, 130, 138; D30/158, 159

See application file for complete search history.

(56) References Cited

U.S. PATENT DOCUMENTS

| | | | | |
|---|---|---|---|---|
| 505,756 | A * | 9/1893 | Dushane | 119/631 |
| 2,544,406 | A * | 3/1951 | Weems | 68/220 |
| D169,673 | S * | 5/1953 | Horton | D4/129 |
| 2,802,229 | A * | 8/1957 | Bangs | 15/143.1 |
| 2,810,147 | A * | 10/1957 | Aman | 15/202 |
| 2,857,609 | A * | 10/1958 | Marder | 15/176.5 |
| 5,327,611 | A * | 7/1994 | Balster et al. | 15/176.4 |
| 5,365,881 | A * | 11/1994 | Sporn | 119/633 |
| 5,485,807 | A | 1/1996 | Bertwell et al. | |
| D380,616 | S | 7/1997 | Leslie et al. | |
| 5,682,837 | A | 11/1997 | Courtney et al. | |
| 6,029,307 | A | 2/2000 | Baudoin | |
| 6,230,716 | B1 | 5/2001 | Minoletti | |
| 6,421,872 | B1 | 7/2002 | Sciandivasci | |
| 6,487,748 | B1 * | 12/2002 | Dardar et al. | 15/167.1 |
| 7,111,352 | B2 | 9/2006 | Yu | |
| 2005/0011030 | A1 | 1/2005 | Gonzalez | |

* cited by examiner

*Primary Examiner* — Mark Spisich
(74) *Attorney, Agent, or Firm* — Trop, Pruner & Hu, P.C.

(57) ABSTRACT

In one embodiment, an ergonomic brush includes a handle grip with finger slots situated between thumb slots and a palm rest extending rearwardly from the finger slots. A bristle base may be adapted to the handle grip, where the bristle base includes a bristle field having a length extending in a direction substantially parallel to a user's hand when engaged in the finger slots.

21 Claims, 6 Drawing Sheets

ERGONOMIC BRUSH

BACKGROUND

Grooming brushes are used for hair grooming of people and animals. Typically such brushes are formed from a handle-based design in which a user grasps a handle with a closed fist and uses a brush portion to groom the subject.

Generally this configuration is not ergonomic in nature, and can cause considerable wrist and hand strain and fatigue. For example, when grooming a subject, the brush is typically pushed or pulled along a direction that is generally perpendicular to the handle axis. This alone can cause considerable strain and fatigue, especially where a user spends a good deal of time brushing. For example, groomers can spend considerable hours performing such grooming. As a result, many such users suffer from fatigue and chronic hand, wrist and arm pain.

Furthermore, while various shapes and sizes of brushes are available, many such brushes lack universality, as a relatively small brush may not be suitable for large subjects such as large pets, while relatively large brushes may not be suitable for other, e.g., smaller subjects. A need thus exists to overcome these deficiencies.

SUMMARY

According to one aspect, the present invention is directed to an apparatus having a handle grip with finger slots situated between two thumb slots and a palm rest extending rearwardly from the finger slots. Still further, a bristle base may be adapted to the handle grip. The bristle base includes a bristle field having a length extending in a direction substantially parallel to a user's hand when engaged in the finger slots. The bristle base can be removeably adapted to the handle grip. Multiple bristle bases can be provided, each having a different configuration of bristle field. Vice versa, multiple handle grips can be provided, each differently configured to accommodate different sizes of users' hands.

Yet another aspect of the present invention is directed to a removable handle grip with finger slots, thumb slots, and a palm rest. The grip can be adapted to an interchangeable bristle base. The base includes a bristle field having a length and a width, where the length-extends substantially parallel to a user's hand when engaged in the finger slots. The base may further include a peripheral collar adapted on the backside of the bristle field, and which may include retention members to retain the removable handle grip.

DETAILED DESCRIPTION

In various embodiments, an ergonomic brush may be provided to enable improved brushing without causing the fatigue and pain that is common in typical brushes. Still further, a brush in accordance with an embodiment of the present invention can be provided with a replaceable bristle assembly, enabling use of an ergonomic grip portion of the brush with various bristle configurations, each of which may be configured for various subjects, e.g., large or small animals, different hair types, or so forth via different sized bristles or other configurations.

Figure 1:
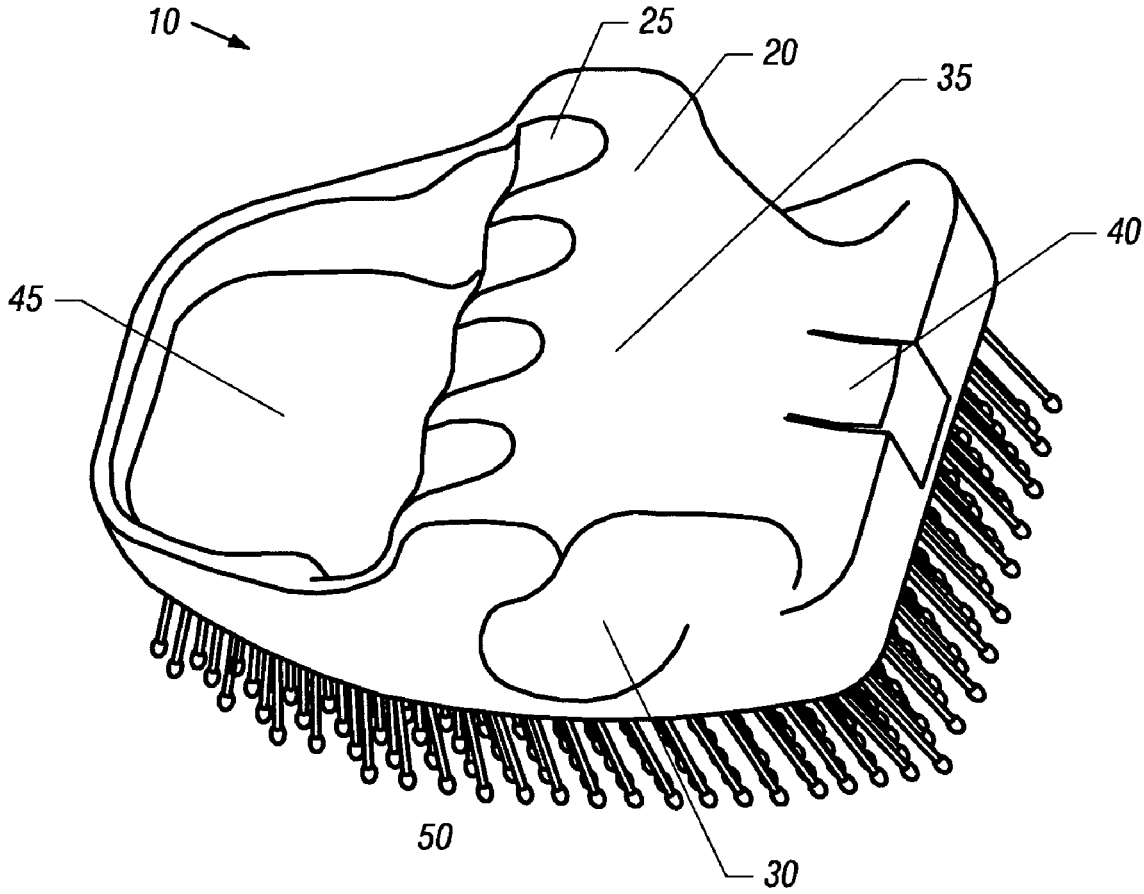
FIG. 1 is an isometric view of a brush in accordance with one embodiment of the present invention.

Referring now to FIG. 1 shown is an isometric view of a brush in accordance with one embodiment of the present invention. As shown in FIG. 1, brush 10 includes a removable handle grip 20 that is adapted to an interchangeable bristle base 45. As shown in FIG. 1, brush 10 may provide for ergonomic use via grip 20. More specifically as shown in FIG. 1, grip 20 includes a plurality of finger slots 25 (e.g., four such finger slots), with corresponding thumb slots 30 adapted on either side of grip 20. Still further, a palm rest 35 may be adapted adjacent the finger slots and thumb slots. Adjacent palm rest 35 may be a quick release mechanism 40 to enable easy removal and replacement of interchangeable bristle base 45. In various embodiments, grip 20 may be made from a compliant or deformable material such as thermoplastic rubber, or elastomer (TPE), to improve the ergonomic features. The curved and tapered design of brush 10 allows use on both large and small subjects, as the brush can be positioned in various manners. For example, a user can use the tip of it, the flat of it, and even use the side of it simply by rolling the arm to get in different areas of the subject.

In this way, ergonomic handling of brush 10 can be realized. That is, during brushing, a comfortable, low energy hand position can be realized, as the hand (and arm) of a user can move in substantially the same pushing/pulling direction in which the brush is moved. In this way, hand, wrist or arm fatigue during operation can be avoided due to this positioning and minimal actuation of wrist muscles during usage. Thus during grooming, a user's wrist may be substantially unflexed, leading to a substantially straight line between arm, wrist and hand. Also, via the configuration shown in FIG. 1, a user can apply more pressure to a matted area while realizing less stress. Furthermore, during operation a user can use a hooking sweep at an end of travel without repositioning the brush in the user's hand. That is, forward and backward motion (and side to side) can be effected without readjusting wrist position, reducing stress on a user.

Still referring to FIG. 1, at a lower portion of bristle base 45, a bristle field 50 may be present. As will be shown more clearly in FIG. 4, bristle field 50 may have a length L that is greater than its width W. In some embodiments, L may be between approximately 5 inches and 7 inches, and W may be between approximately 4 inches and 5 inches. By providing a first axis having a long length in the general direction of travel (i.e., a first axis M parallel to the general direction of travel), which may also be coincident with hand, wrist, and arm direction, usage is easier. The smaller width W may have a second axis N that is thus substantially perpendicular to the general direction of travel.

In other words, by holding the brush using grip 20, there is minimal wrist pressure, as there is little or no wrist movement needed, and generally it is arm motion that causes the brush to move. This increased bristle area provided by bristle field 50 may be realized because more force can be applied via a user's arm. In contrast, a conventional brush requires more significant wrist use and most of the force goes through the wrist, making it very difficult to groom a thick-haired subject such as a shaggy haired dog with a large bristle field.

In various embodiments, because the length of bristle field 50 is larger than its width, and it is also aligned parallel with the typical direction of travel, there is no need to reposition the brush in a user's hand during full travel of the brush. In contrast, a conventional brush generally has a width of the bristle field that is small and that is aligned in the typical direction of travel. When a user has a conventional brush in hand, doing a long sweep of the brush causes the user to re-grip the handle a number of times.

In other words, a conventional brush is held from the side and usually because of the way the wrist is configured, a user moves the brush across the thin width of a bristle field. Instead using a brush in accordance with an embodiment of the present invention, when the brush is held a subject can be brushed across the full length of the brush and without wrist strain. Because of the ability to provide different bases, there also exists the ability to provide different bristle fields 50, e.g., with varying sizes, shapes and numbers of bristles present within the field.

Figure 2:
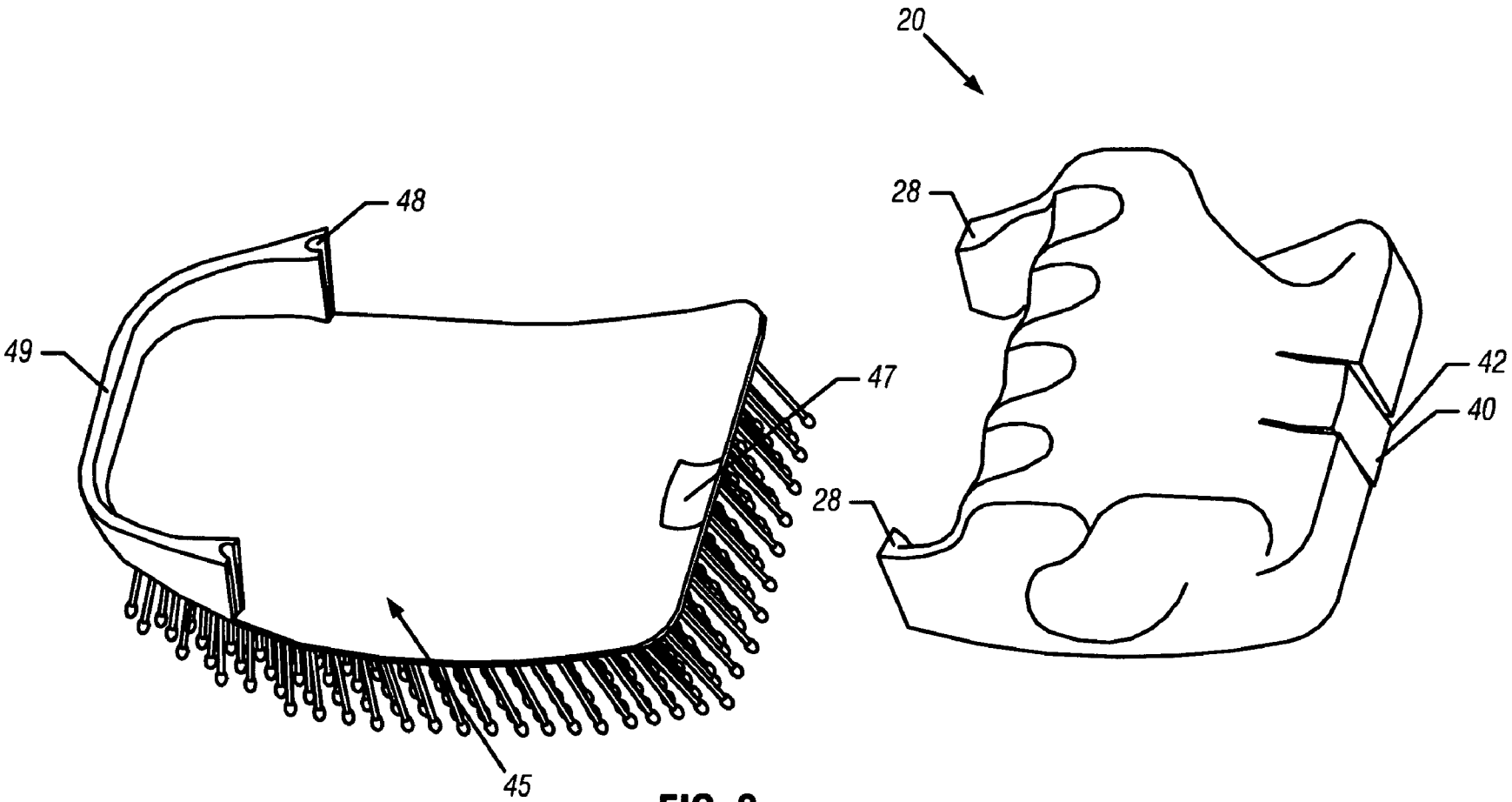
FIG. 2 is an exploded view of a brush with a grip separated from its base in accordance with one embodiment of the present invention.

Referring now to FIG. 2, shown is an exploded view of a brush with grip 20 separated from base 45. As shown, grip 20 may include a pair of alignment and hook mechanisms 28 to enable adaptation of grip 20 to base 45. As further shown in FIG. 2, base 45 may include recessed guide and latch members 48 to receive mechanisms 28 and lock them into place. As a further support for the adaptation of grip 20 to base 45, a quick release 40 may be actuated to lock a spring latch 42 that can moveably lock in place into a recess 47 of bristle base 45, which may snap in spring latch 42. To cause a release of grip 20 from base 45, a user may press down on quick release 40 to release spring latch 42 from recess 47. Also shown in FIG. 2 is a collar 49 adapted about the periphery of base 45, and which may be configured in a generally semi-circular or other semi-shaped fashion. When joined as shown in FIG. 1, the brush thus has a cup or recess formed by base 45 and grip 20 to support or house a user's fingertips extending over finger slots 25.

Figure 3:
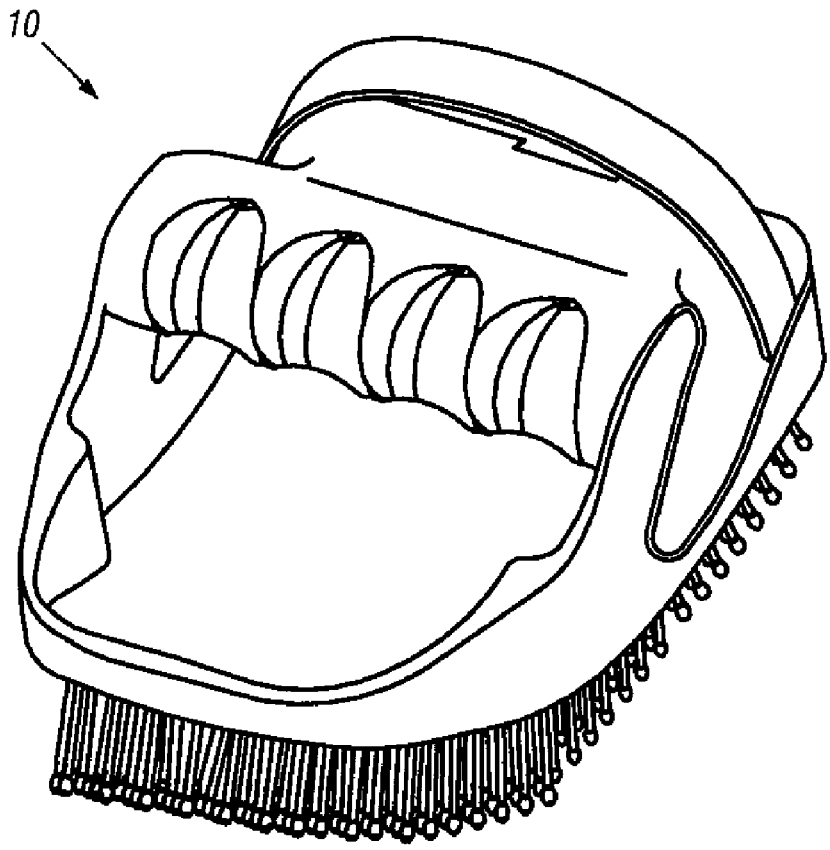
FIG. 3 is a top front view of a brush in accordance with one embodiment of the present invention.
Figure 4:
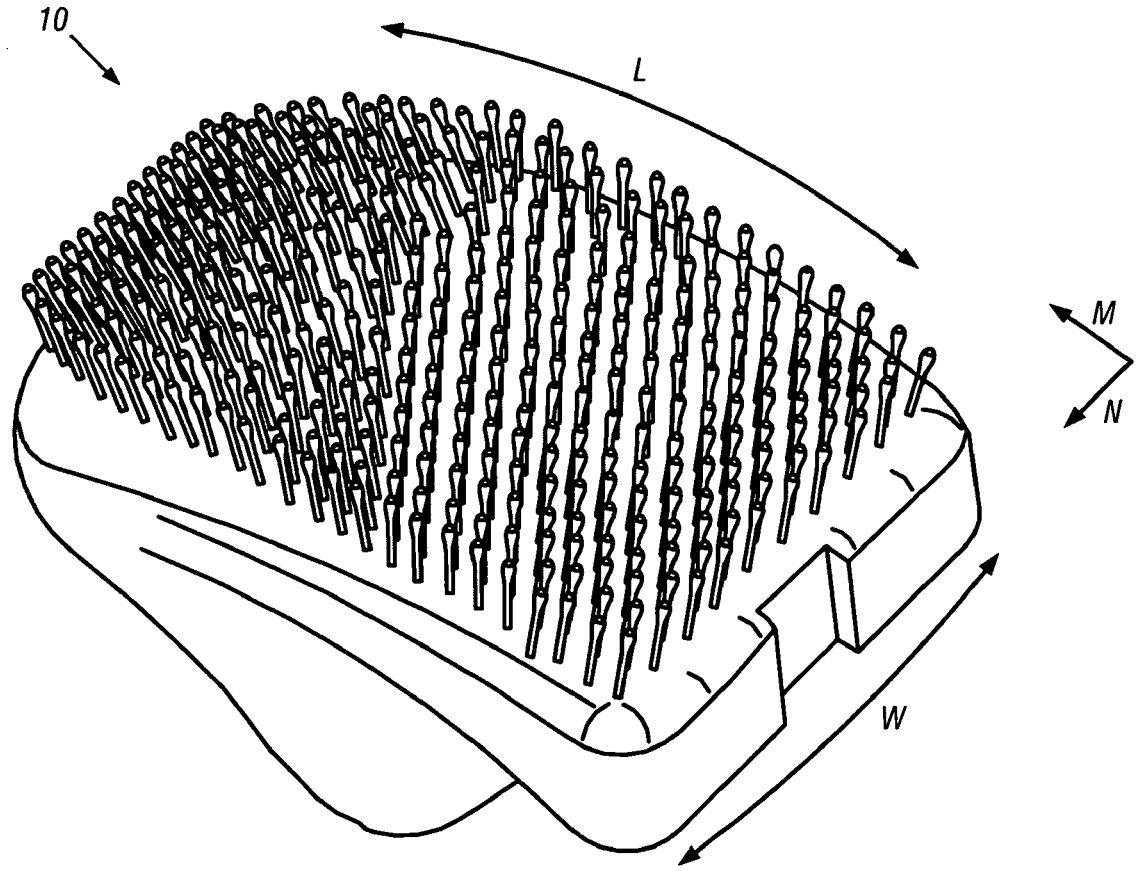
FIG. 4 is a rear bottom view a brush in accordance with one embodiment of the present invention.

FIG. 3 shows a top front view of brush 10, while FIG. 4 shows a rear bottom view of brush 10, showing length L and width W of bristle field 50 and the first and second axes M and N. As seen especially in FIG. 4, brush 10 may have an increased bristle area to provide for more brushing coverage and less brush cleaning. In some implementations a VELCRO™ or other adaptable or adjustable strap may be affixed to grip 20, e.g., adjacent thumb slots 30 and extending across palm rest 35 to enable a user to secure brush 10 to the hand.

A two-part construction thus can be realized that allows the entire brush area to be easily removed and reattached/replaced such that interchangeable bristle configurations can be used. Furthermore, the curved and tapered design of grip 20 allows its use on both large and small pets by using different areas of brush field 50 for different areas of different pets. The ergonomic nature of the brush allows it to be pushed, pulled or moved sideways, leading to a more naturally efficient brushing motion, allowing less stress on arm, wrist and hand.

Figure 5:
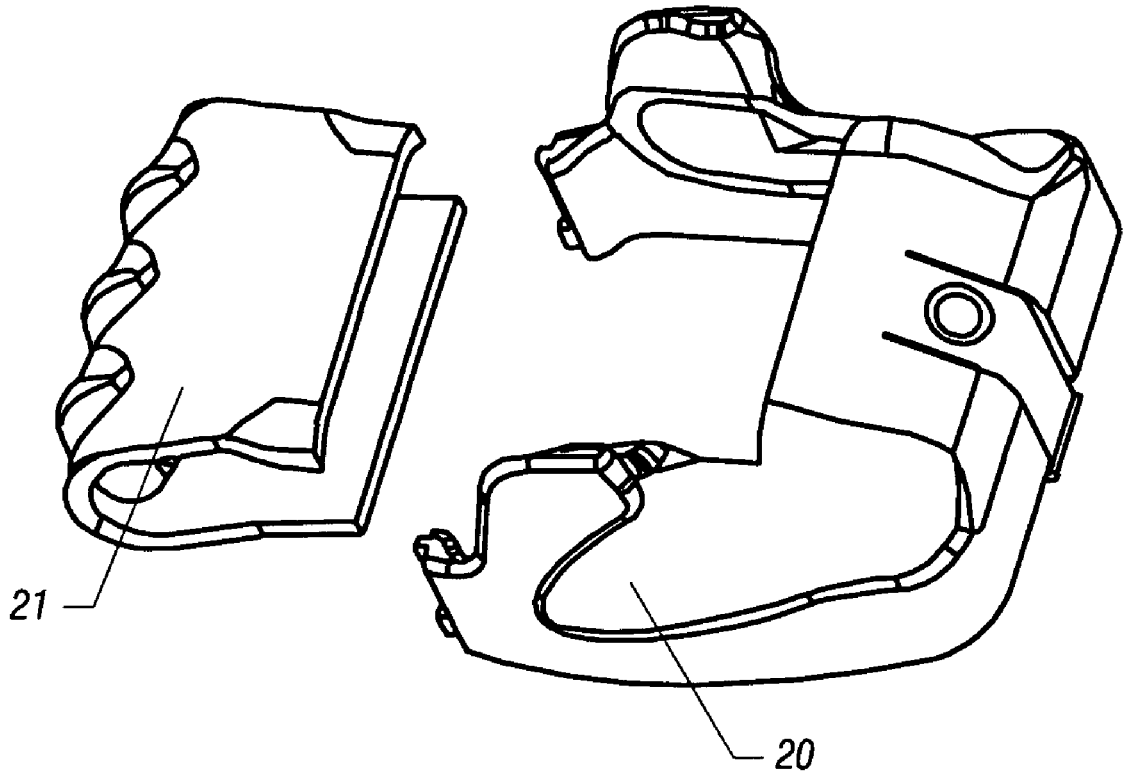
FIG. 5 is an exploded view of a grip assembly in accordance with one such embodiment.

In other implementations, a grip may be provided with an adjustable and removable finger grip such that multiple such finger grips can be provided to enable better handling by users with different hand sizes. Different manners of adapting such a removable finger grip portion to a grip can be realized. Referring now to FIG. 5, shown is an exploded view of a grip assembly in accordance with one such embodiment. As shown in FIG. 5, a grip base 20, which may include various latch features and lock mechanisms as described above, may lack a finger grip portion as shown, e.g., in FIG. 1. Instead, a separate, removable finger grip portion 21 may be provided that can be configured within grip 20. Different manners of adapting finger grip portion 21 to grip 20 can be realized, for example a simple sliding in and sliding out, latch mechanisms or so forth. Differently sized finger grip portions 21 may be provided to enable better control by users having different finger sizes. In certain embodiments, finger grip portion 21 may be formed from the same material used for grip 20. As shown in FIG. 5, finger grip portion 21 can include a top portion that can act at least partially as the palm rest, while in other implementations finger slot portion 21 may be minimally crafted such that the majority of palm rest is part of grip 20.

Figure 6:
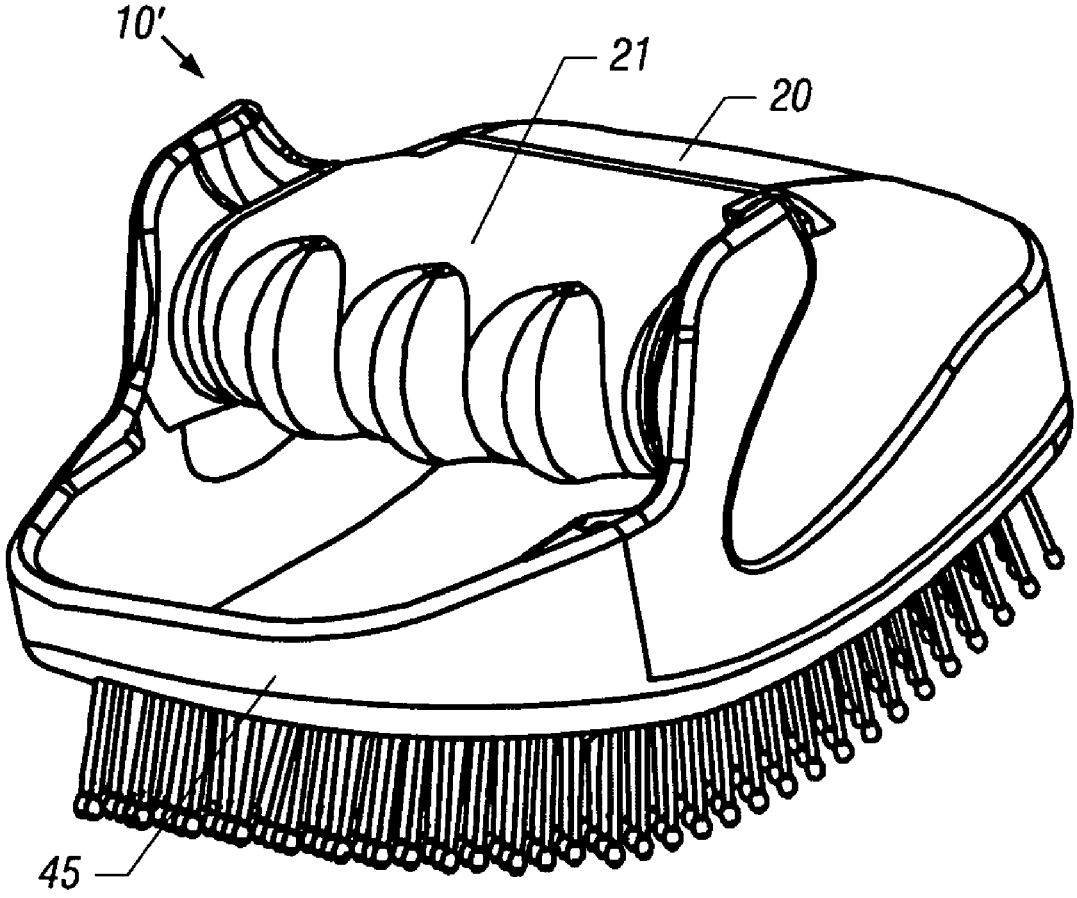
FIG. 6 is an isometric view of a brush having an adjustable finger grip portion.

Referring now to FIG. 6, shown is an isometric view of a brush 10' having an adjustable finger grip portion. As shown in FIG. 6, grip 20 includes a finger grip portion 21, which may be removeably coupled to grip 20 prior to the adaptation of grip 20 to base 45. In this way, different users can be better accommodated by various sizes of finger grip portion 21.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An apparatus comprising:

a handle grip including a plurality of finger slots situated between a first thumb slot and a second thumb slot, and a palm rest extending rearwardly from the finger slots and adapted between the first and second thumb slots; and a bristle base adapted to the handle grip, where the bristle base includes a bristle field having a length and width, the length extending in a direction substantially parallel to a user's hand when engaged in the finger slots, wherein the bristle base is removeably adapted to the handle grip, wherein the handle grip is formed from a first portion including the finger slots and a second portion including the thumb slots, wherein the first portion is removeably adapted to the second portion.

2. The apparatus of claim 1, wherein the length is substantially greater than the width and the apparatus is to be held by a user via the handle grip and moved in a direction substantially parallel with the length.

3. The apparatus of claim 1, wherein the handle grip further includes a spring latch and a release mechanism to engage and disengage the bristle base.

4. The apparatus of claim 3, wherein the bristle base further includes a lock member to receive the spring latch, wherein the release mechanism is actuatable to engage the spring latch in the lock member and vice-versa.

5. The apparatus of claim 4, wherein the handle grip further includes a plurality of guide members and a plurality of hooks, wherein the guide members are to guide the handle grip when being adapted to the bristle base, and the hooks are to be latched by corresponding latch members of the bristle base.

6. The apparatus of claim 5, wherein the bristle base further includes a collar on a reverse side of the bristle field.

7. The apparatus of claim 6, wherein the latch members of the bristle base are located in the collar.

8. The apparatus of claim 7, wherein the collar and the handle grip form a cup to support a user's fingertips.

9. The apparatus of claim 1, further comprising a plurality of bristle bases each having a different configuration of bristle field.

10. The apparatus of claim 1, further comprising an adjustable strap adapted about the handle grip.

11. An ergonomic brush comprising:

a removable handle grip including a plurality of finger slots situated between a first thumb slot and a second thumb slot, and a palm rest extending rearwardly from the finger slots and adapted between the first and second thumb slots; and an interchangeable bristle base adapted to the removable handle grip including a bristle field having a length and a width, the length extending in a direction substantially parallel to a user's hand when engaged in the finger slots, and a peripheral collar adapted about a portion of a backside of the bristle field, the peripheral collar including retention members to retain the removable handle grip, wherein the joined removable handle grip and the interchangeable bristle base form a recess to support a user's fingers extending over the finger slots.

12. The ergonomic brush of claim 11, wherein the removable handle grip further includes a spring latch and a release mechanism to engage and disengage the interchangeable bristle base.

13. The ergonomic brush of claim 12, wherein the interchangeable bristle base further includes a lock member to receive the spring latch, wherein the release mechanism is actuatable to engage the spring latch in the lock member and vice-versa.

14. The ergonomic brush of claim 11, further comprising a plurality of interchangeable bristle bases each having a different configuration of bristle field.

15. The ergonomic brush of claim 11, wherein the ergonomic brush is to be moved substantially parallel to the length during grooming.

16. The ergonomic brush of claim 11, wherein the removable handle grip is formed from a first portion including the finger slots that is removeably coupled to a second portion.

17. The ergonomic brush of claim 16, further comprising a plurality of first portions, each having differently sized finger slots.

18. An apparatus comprising:

a removable handle grip including a first removable portion having a plurality of finger slots, the first removable portion adapted to a second grip portion including a first thumb slot and a second thumb slot, the first removable portion situated between the first thumb slot and the second thumb slot, the second grip portion further including a spring latch and a release mechanism; and an interchangeable bristle base adapted to the removable handle grip including a bristle field having a length and a width, the length substantially greater than the width and extending in a direction substantially parallel to a user's hand when engaged in the finger slots, a lock member to receive the spring latch, and a peripheral collar adapted about a portion of a backside of the bristle field, the peripheral collar including retention members to retain the removable handle grip, wherein the joined removable handle grip and the interchangeable bristle base form a recess to support a user's fingers extending over the finger slots.

19. The apparatus of claim 18, wherein the apparatus is to be held by a user via the removable handle grip and moved in a direction substantially parallel with the length.

20. The apparatus of claim 18, wherein the removable handle grip further includes a plurality of guide members and a plurality of hooks, wherein the guide members are to guide the removable handle grip when being adapted to the interchangeable bristle base, and the hooks are to be latched by the corresponding retention members of the interchangeable bristle base.

21. The apparatus of claim 20, further comprising an adjustable strap adapted about the removable handle grip.

* * * * *